United States Patent [19]

Moore

[11] Patent Number: 4,834,434

[45] Date of Patent: May 30, 1989

[54] SAFETY LATCH FOR A NUCLEAR WASTE CONTAINER

[76] Inventor: Walter J. Moore, P.O. Box 352, Aiken, S.C. 29801

[21] Appl. No.: 867,133

[22] Filed: May 27, 1986

[51] Int. Cl.[4] ..... E05C 19/08

[52] U.S. Cl. ..... 292/253; 220/324; 292/67; 292/246; 292/282; 16/319; 16/350; 16/362

[58] Field of Search ..... 292/253, 67, 249, 247, 292/246, 286, 282, 281, 292, 250, 248, D9, 299, 109, 114, 272; 16/319, 343, 344, 345, 350, 362, 363; 220/324

[56] References Cited

U.S. PATENT DOCUMENTS

| | | | |
|---|---|---|---|
| 357,935 | 2/1887 | McAdam | 292/253 X |
| 624,286 | 5/1899 | Andrus . | |
| 918,264 | 4/1909 | Bender | 292/250 |
| 1,020,107 | 3/1912 | McCloskey | 292/238 |
| 1,057,522 | 4/1913 | Brace . | |
| 1,383,701 | 7/1921 | Ellis . | |
| 1,458,330 | 6/1923 | Gallagher | 292/250 |
| 1,596,054 | 8/1926 | Leigh . | |
| 1,601,352 | 9/1926 | Dougherty . | |
| 1,605,208 | 11/1926 | Blakely | 292/238 X |
| 1,800,804 | 4/1931 | Nelson | 292/D9 X |
| 1,815,970 | 7/1931 | Eggerss | 292/253 X |
| 2,180,994 | 11/1939 | Mullany | 292/246 |
| 2,459,666 | 1/1949 | Marus | 292/246 |
| 2,477,648 | 8/1949 | Piggot | 250/108 |
| 2,559,681 | 7/1951 | Senseman | 292/250 |
| 3,647,250 | 3/1972 | Brown | 292/246 |
| 3,831,987 | 8/1974 | Misenheimer, III | 292/262 X |
| 4,035,009 | 7/1977 | Jacobs | 292/246 |
| 4,371,092 | 2/1983 | Teague | 220/324 |

FOREIGN PATENT DOCUMENTS

| | | | |
|---|---|---|---|
| 527909 | 8/1921 | France | 292/250 |
| 3971 | of 1892 | United Kingdom | 292/250 |
| 345586 | 3/1931 | United Kingdom | 292/285 |

*Primary Examiner*—Gary L. Smith
*Assistant Examiner*—Eric K. Nicholson
*Attorney, Agent, or Firm*—Benoni O. Reynolds

[57] ABSTRACT

A permanent locking device for a nuclear waste container which, in combination with a lid and a box, utilizes a dee-shaped ring held by a wide, flat hinge and a protruding narrow malleable metal retaining strap. The ring can rotate or slide up and down within the hinge, as well as slide side to side. The hinge has a slot in its top for temporarily holding the ring in an up position while the lid is open and the box is being loaded with nuclear waste. When the lid is closed and the ring is disengaged from the slot, the ring can be quickly dropped to a down position permitting the retaining strap to extend through the ring. The retaining strap can then be readily bent down and over the circular (bottom) portion of the ring, to form a permanent seal. A deformable rubber gasket is positioned between the lid and the top edges of the box to form an air tight seal. The open cavity within the hinge permits the gasket to deform still further and protects the locking device from breakage when the containers are stacked more than a single container high.

2 Claims, 2 Drawing Sheets

SAFETY LATCH FOR A NUCLEAR WASTE CONTAINER

BACKGROUND OF THE INVENTION (1) Field of Invention:

This invention relates to latches or fasteners for containers. Particularly it relates to means for permanently securing lids of box type containers used for the storage of low level nuclear waste.

(2) Description of Prior Art:

The storage of low level nuclear waste poses container problems not faced by the storage of conventional materials. Safety in handling and in storage constitute paramount considerations. Locking devices are usually for one-time use and must provide an air tight seal between the lid and the box to obviate any leakage.

Fasteners for boxes found in the early art would not meet the needs of nuclear storage. The invention of Andrus (1899) used the technique of folding a pliable retainer wire, attached to the box, through and over a loop attached to the lid. Permanent, air tight sealing was obviously not a consideration. Also, the wire members were of light construction and designed for repeated openings and closings of the container.

Adjustable locking devices are found in other applications, such as gate latches. Brace (1913) utilized a key stone shaped loop which slipped beneath one of a series of downwardly projecting lips. Permanence was not a factor in its design. The can fastening of Ellis (1921) introduced a tongue which was affixed to the bottom of a container in a position where the tongue automatically entered a keeper affixed to the cover when the container was closed. The upper portion of the tongue was then bent down over the top edge of the keeper to hold the cover in place. No capability for adjustment or air tight sealing were provided. The design might allow a slight downward travel of the cover. Leigh's cover fastener of 1924 is similar to the pliable wires of Andrus but a plurality of the fasteners were distributed about the periphery of the upper portion of the container. The retainer wire could easily be restraightened to permit reentry into the container.

Slidability is first found in the fastening device of Dougherty (1923). A closed loop affixed to the lower part of the container rotated in a bearing and could be raised upward to disengage the loop from the keeper or lug attached to the cover. The loop could then be slid horizontally in the bearing to get the loop out of the way. The loop served only this limited purpose and no adjustability or sealing was provided.

The closure fastener of Marus (1946) again utilized wire loops. The improvement appeared to be that the tongue, affixed to the lower part of the container, was hinged as a separate element and folded up through, and downwardly over, the upper loop on the cover to fasten the container.

Lock-arm closure devices are frequently used on enclosures containing radiation sources. Piggot's Ragiation Projector (1949) utilized a cover handle assembly having two pins which engaged a pair of hooks attached to the bottom of the container. The handle pivoted downward to lock the cover in place. Fold-over locking arms are also found on garbage cans where resilient side walls permit a tight or sealing fit when the pivoted loops on the cover are slipped over a locking arm on the base of the container.

The most recent application of permanent lid holding assemblies for waste containers is found in Teague's patent of 1983. The reverse of the tongue and keeper of Ellis, a flexible angle flange tongue, affixed to the cover, slips downwardly, when closed, into a plurality of metal stirrups and is held therein by a retaining strip on the tongue which springs forward once the tongue is in place. Some flexibility is present in that the tongue, when in place, can move downwards but not upwards. Sealing gaskets were provided between the lid and the box.

As can be concluded from the above observations, the combination of loops and locking arms as locking devices is not new in the art. However, most devices are for continued use and are not permanent in nature. None of the devices had a provision for keeping the ring in an upright position to facilitate loading. Also none of the devices had the strength and safety of the ring and metal retaining strap of the present invention. The flexibility in the design of the present invention also assures a tight seal between the lid and the box when the container is in a closed condition. The design also provides some give in the structure of the latch under a stacking environment.

Prior art known to this inventor includes the following U.S. Pat. Nos.:

624,286, May 1899, Andrus;
1,057,522, Apr. 1913, Brace;
1,383,701, July 1921, Ellis;
1,596,054, Aug. 1926, Leigh;
1,601,352, Sept. 1926, Dougherty;
2,459,666, Jan. 1949, Marus;
2,477,648, Aug. 1949, Piggot et al.;
4,035,009, July 1977, Jacobs;
4,371,092, Feb. 1983, Teague.

SUMMARY OF THE INVENTION

The present invention is a permanent locking device for a nuclear waste container having a lid and a box as the containment enclosures. Because of the few, simple components of the present invention it is easily and inexpensively manufactured and reliable in its use.

According to the preferred embodiment of this invention, a ring means is attached to the lid of a nuclear waste container for the dual purposes of raising or lowering the lid and of securing the lid to the box of the container. Ring means is an endless dee-shaped ring, having a circular portion and a non-circular portion for ease of handling the lid.

A support means is also attached to the lid of the nuclear waste container for holding the ring means in a slidable and rotatable position. Support means is a wide, flat hinge which encompasses the ring means along the non-circular portion of the ring means and permits the ring means to slide up and down within the hinge as well as slide side to side. The hinge also contains a slot in its top for temporarily holding the ring means in an up, unlocked position, for ease of loading the box.

A seal means provides an air tight seal between the lid and the box when the container is in a closed and locked condition. Seal means is a deformable rubber gasket positioned along the upper edges of the box to provide a permanent seal between the lid and the box when the container is in a closed and locked condition.

A retaining means is attached to the box of the nuclear waste container for holding the ring means in a down position to permanently seal the lid to the box. Retaining means is a narrow, malleable metal strap which is positioned so as to extend or protrude through the ring means when the lid and the ring means are in a down position and which metal strap, when bent downward over the circular portion of the ring means, will hold the lid permanently in a closed and sealed position.

OBJECTIVES OF THE INVENTION

The objectives of the present invention are to provide a locking device for nuclear waste storage containers which will give:

(1) a permanent, tamper proof fastening between the lid and the box;

(2) a simple and safe sealing process which requires no special tools or cumbersome objects to accomplish;

(3) a latch that is safe from accidental release while being handled or stacked;

(4) a latch whose essential parts are all attached to the lid or the box so that the parts cannot be lost or misplaced;

(5) an adjustable air tight gasket to assure a leak proof seal between the lid and the box;

Other objectives and advantages of the present invention will be apparent during the course of the following detailed description, appended claims and accompanying drawings.

DETAILED DESCRIPTION OF THE PREFERRED EMBODIMENT OF THE INVENTION

Figure 1:
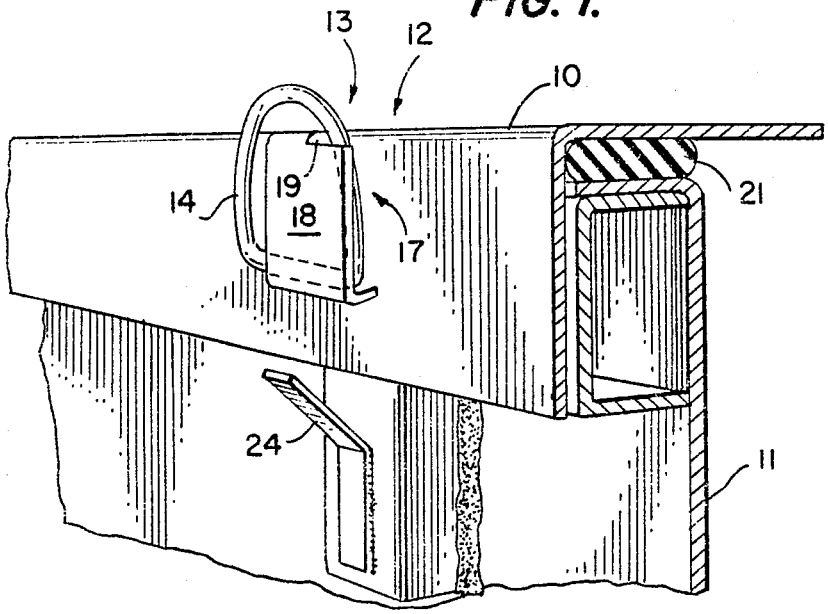
FIG. 1 is an elevation view from the right front of the safety latch for a nuclear waste container, which latch was constructed in accordance with the principles of the present invention, showing the lid, hinge, ring and the protruding retaining strap.

The present invention is a permanent locking device for a nuclear waste container having a lid and a box as the basic components of the container. The safety latch is self contained and all parts are affixed to the container. Throughout the following description of the present invention like reference numerals are used to denote like parts disclosed in the accompanying drawings FIGS. 1–8.

As shown in FIG. 1, the safety latch for a nuclear waste container comprises only a few simple components mounted to either lid 10 or to box 11 of a nuclear waste container, shown generally at reference numeral 12. A ring means, shown generally at reference numeral 13, is attached to lid 10 of a nuclear waste container 12 for the dual purposes of raising or lowering lid 10 and of securing lid 10 to box 11 of nuclear waste container 12. Ring means 13 is an endless dee-shaped ring 14 having a circular porion 15 and a non-circular portion 16 for ease of handling lid 10. Circular portion 15 of ring 14 can be easily grasped by the person loading box 11 and lid 10 raised or lowered to a desired position. Preferably ring 14 would be constructed of 5/16 inch circular steel rod having the ends thereof properly secured to one another by welding or the like. Non-circular portion 16 of ring 14 would be forged so as to be perfectly horizontal and about $2\frac{1}{2}$ inches in width. Circular portion 15 of ring 14 would be forged so as to form a perfect semicircle approximately 1 3/16 inches in radius whose ends extend to join non-circular portion 16 as a base for ring means 13.

Figure 2:
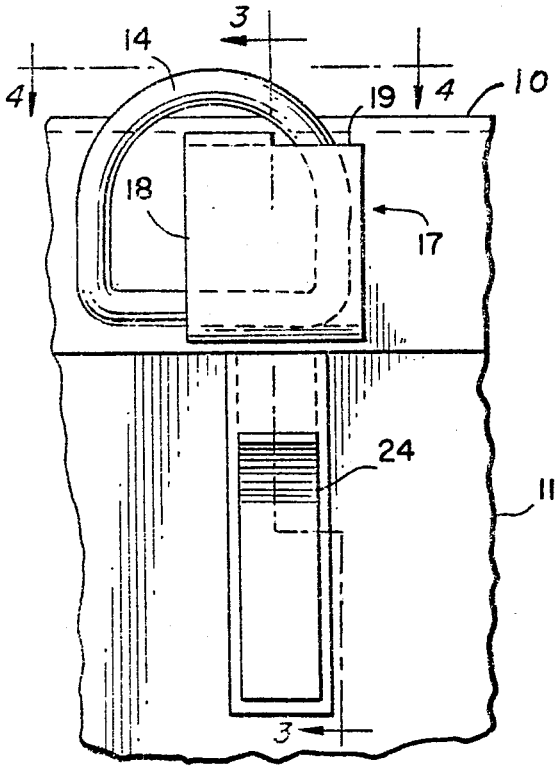
FIG. 2 is a close-up front view of the present invention, showing the ring in the up position resting in the slot in the top of the hinge.
Figure 3:
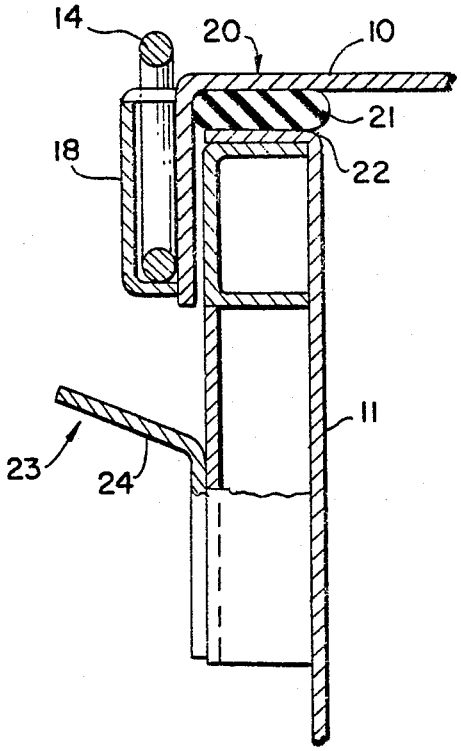
FIG. 3 is a sectional view of the present invention, taken substantially along line 3—3 of FIG. 2, showing the rubber gasket resting on the upper edge of the box which holds the nuclear material.

Support means, shown generally at reference numeral 17 in FIGS. 1 and 2, is also attached to lid 10 of nuclear waste container 12 for holding ring means 13 in a slidable and rotatable position. Support means 17 is a wide, flat hinge 18 which encompasses ring means 13 along non-circular portion 16 of ring 14 and permits ring means 13 to slide up and down vertically within hinge 18 as well as slide horizontally side to side. Preferably hinge 18 would be $1\frac{7}{8}$ inches wide by 2 inches high and constructed of a short, channel shaped, piece of $\frac{1}{8}$ inch strap metal. Hinge 18 would be welded to lid 10 with a clearance of 7/16 inch therefrom to allow ring 14 to ride behind hinge 18 and slide both vertically and horizontally in the cavity within hinge 18. The diameter of ring 14 would be slightly less than the depth of hinge 18 in relation to lid 10.

Figure 4:
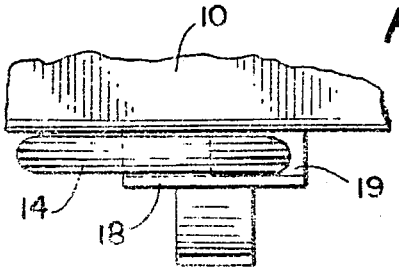
FIG. 4 is a plan view of the present invention taken along line 4—4 of FIG. 2, showing the top of the ring and the hinge while the ring is resting in the slot in the top of the hinge.

Hinge 18 also contains a slot 19 in its top for temporarily holding ring means 13 in an up, unlocked position, as shown in FIGS. 1–4, for ease of loading box 11. The person loading box 11 need only rotate ring 14 upwardly within hinge 18 and slide ring 14 to the left into slot 19 where ring 14 can rest temporarily until the loader is ready to close and seal nuclear waste container 12. As shown in FIGS. 1, 2 and 4, slot 19 is cut sufficiently wide to easily accommodate the diameter of ring 14 and sufficiently deep so that slot 19 extends about half way into the width of hinge 18. Preferably the slot would be 7/16 inch wide and about 1 inch deep to accommodate a ring 14 which is 5/16 inch in diameter. Hinge 18 is sufficiently narrow in relation to the inner dimensions of ring 14 to permit ring 14, when centered in hinge 18, to easily clear, and to drop down over, hinge 18 without contact other than at the base of hinge 18.

Figure 7:
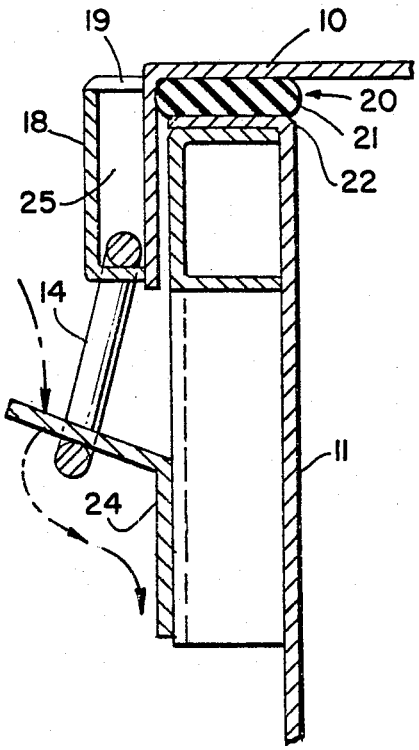
FIG. 7 is a sectional view of the present invention from the right side thereof, showing how the retaining strap is bent down over the circular portion of the ring.
Figure 8:
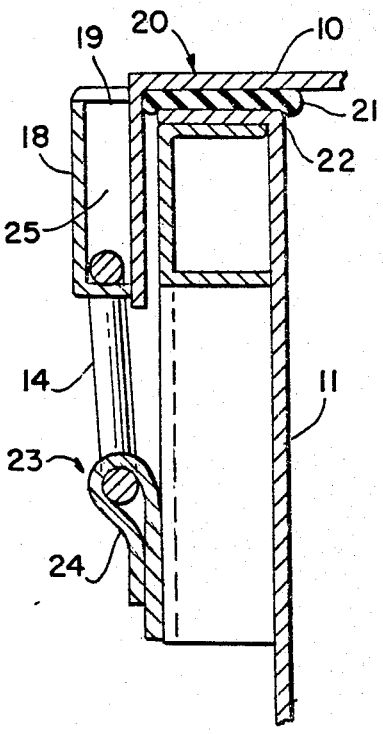
FIG. 8 is the same view of the present invention as shown in FIG. 7 but showing the retaining strap in its closed and locked position.

A seal means, indicated generally at reference numeral 20, provides an air tight seal between lid 10 and box 11 when nuclear waste container 12 is in a closed and locked condition as shown in FIG. 8. Seal means 20 is a gasket, preferably of deformable rubber, positioned along the upper edges, shown generally at reference numeral 22, of box 11, to provide a permanent seal between lid 10 and box 11 when nuclear waste container 12 is in a closed and locked condition. As can be seen by comparing the heights of gaskets 21 in FIGS. 7 and 8, the tightness of the seal can be varied by how tightly ring 14 is drawn down to box 11.

Figure 5:
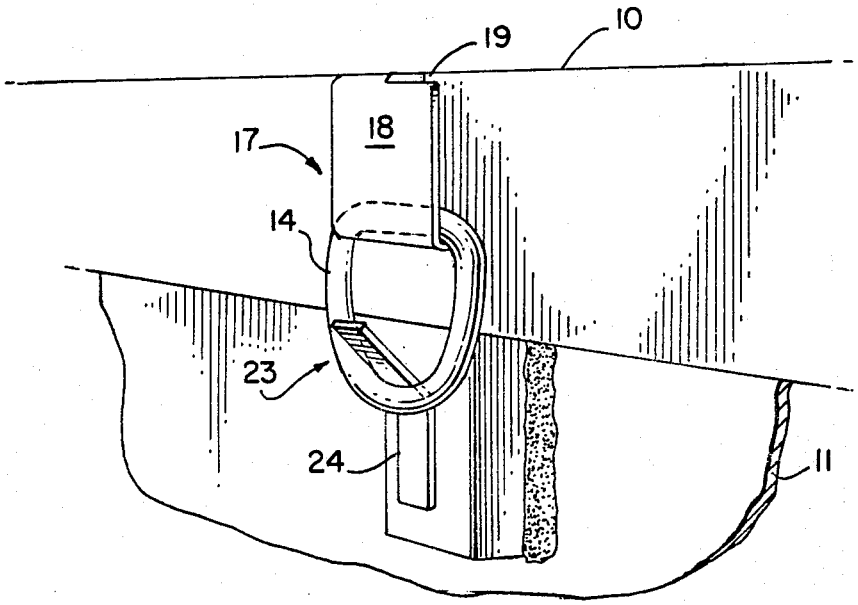
FIG. 5 is an elevation perspective view from the right front of the present invention showing the ring in the down position resting over the protruding portion of the retaining strap.
Figure 6:
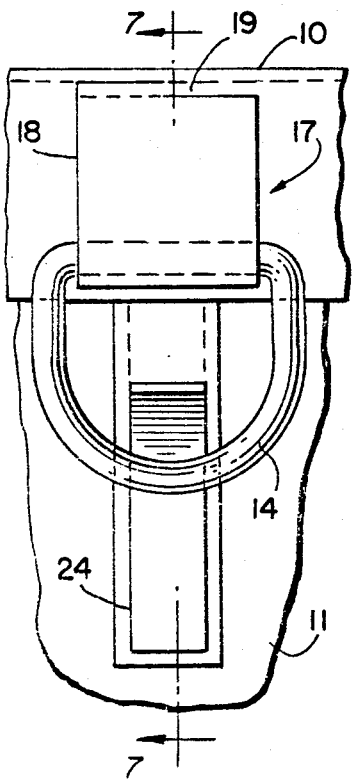
FIG. 6 is front view of the present invention showing the ring in the down position resting over the protruding portion of the retaining strap.

As best shown in FIG. 7, a retaining means, indicated generally at reference numeral 23, is attached to box 11 of nuclear waste container 12 for holding ring means 13 in a down position to permanently seal lid 10 to box 11. Retaining means 23 is a narrow, malleable metal strap 24 which is positioned, as shown in FIG. 5, so as to extend or protrude through ring means 13 when lid 10 and ring means 13 are in a down position and which metal strap 24, when bent downwards over circular portion 15 of ring means 13, will hold lid 10 permanently in a closed and sealed position. Metal strap 24 is preferably made of ⅛ inch strap metal, secured to the front of box 11 by welding and extends outwardly from the wall of box 11 at approximately a 20 degree angle to the horizontal plane. As shown in FIG. 7, metal strap 24 is positioned to insure that it is in proper grip range when nuclear waste container 12 is ready to be closed and sealed.

As shown in FIG. 1, while loading box 11, the loader can flip ring 14 into an up position and move it to the left into slot 19 where it will be secure and out of the way until nuclear waste container 12 is fully loaded and ready to be closed and locked. When loading is completed, the loader slips ring 14 to the right, freeing it from slot 19, and drops ring 14 into the down position over metal strap 24, as shown best in FIG. 7. As all the components of the present invention are securely attached to either lid 10 or box 11, none of the parts can be lost or misplaced and are there ready to be used. A permanent, air tight seal is then begun by gripping metal strap 24 with a standard pair of vice grip pliers (not shown) or the like, and bending metal strap 24 downwardly toward the base of box 11. Any small object, such as an 18 to 24 ounce shop hammer (not shown) is then used to complete the sealing process. Metal strip 24 is hammered sharply, forcing the extension of metal strap 24 in a downward direction until the required compression of gasket 21 is reached to insure an air tight seal. The present invention allows the compression or deforming of gasket 21 to be increased, if necessary, to insure this leak proof seal, by merely increasing the downward position of metal strap 24.

Hinge 18 is specially designed to allow more compression or deforming of gasket 21 when boxes 11 are stacked more than a single container high. As hinge 18 is C-shaped, an open cavity 25 is provided therein which is large enough to allow ring 14 to freely slide up within hinge 18 as lid 10 is compressed downwardly by the container or containers above it. Thus, when using the present invention where containers are stacked more than one container high, there is no danger of accidentally releasing any of the locking devices. The present invention provides a permanent, tamper proof seal that is very simple, fast and safe to accomplish in the nuclear waste environment.

I claim:

1. A permanent locking device for a nuclear waste container which, in combination with a lid, a box, and a seal means for providing an air tight seal, comprising:

an endless D-shaped ring, having a circular portion and a non-circular portion, attached to said lid for raising or lowering said lid and securing said lid to said box, and a wide, flat hinge, attached to said lid, for holding said D-shaped ring in a slidable and rotatable position, said hinge encompasses said D-shaped ring along the non-circular portion of D-shaped ring and permits said D-shaped ring to slide vertical up and down within said hinge as well as to slide horizontally side to side, and a slot in the top of said hinge for temporarily holding said D-shaped ring in an up, unlocked position, for ease of loading said box, and a narrow malleable metal strap, attached to said box, for holding said D-shaped ring in a down position to permanently seal said lid to said box, said metal strap is positioned so as to extend through said D-shaped ring when said lid and said D-shaped ring are in a down position and said metal strap, when bent downwards over the circular portion of said D-shaped ring, holds said lid permanently in a closed and sealed position.

2. A permanent locking device for a nuclear waste container which, in combination with a lid, a box, a seal means for providing an air tight seal and a narrow malleable metal strap to hold said lid permanently in a closed and sealed position, comprising:

an endless D-shaped ring, having a circular portion and a non-circular portion, attached to said lid for raising or lowering said lid and securing said lid to said box by means of said metal strap when said metal strap is bent downwards over said circular portion of said D-shaped ring, and a wide, flat hinge, attached to said lid, for holding said D-shaped ring in a slidable and rotatable position, said hinge encompasses said dee-shaped ring along said non-circular portion of D-shaped ring and permits said D-shaped ring to slide vertical up and down within said hinge as well as to slide horizontally side to side, and a slot in the top of said hinge for temporarily holding said D-shaped ring in an up, unlocked position, for ease of loading said box.

* * * * *